US011702934B2

(12) United States Patent
Wang

(10) Patent No.: US 11,702,934 B2
(45) Date of Patent: Jul. 18, 2023

(54) ANNULAR DETACHABLE RUBBER PROBE SIDEWALL CONTACT DEVICE

(71) Applicant: Shaobin Wang, Shaanxi (CN)

(72) Inventor: Shaobin Wang, Shaanxi (CN)

( * ) Notice: Subject to any disclaimer, the term of this patent is extended or adjusted under 35 U.S.C. 154(b) by 7 days.

(21) Appl. No.: 17/546,059

(22) Filed: Dec. 9, 2021

(65) Prior Publication Data

US 2022/0098980 A1 Mar. 31, 2022

(30) Foreign Application Priority Data

Dec. 9, 2020 (CN) ..... 202011429456.1

(51) Int. Cl.
*E21B 49/10* (2006.01)

(52) U.S. Cl.
CPC ..... *E21B 49/10* (2013.01)

(58) Field of Classification Search
CPC ..... E21B 49/10
USPC ..... 73/152.26
See application file for complete search history.

(56) References Cited

U.S. PATENT DOCUMENTS 3,104,712 A * 9/1963 Whitten ..... E21B 49/10 251/297
6,230,557 B1 * 5/2001 Ciglenec ..... E21B 49/10 73/152.01
7,603,897 B2 * 10/2009 Gilbert ..... E21B 49/10 73/152.25
9,816,346 B2 * 11/2017 Heggestad ..... E21B 23/06
10,119,397 B2 * 11/2018 Shaobin ..... E21B 49/10
10,711,608 B2 * 7/2020 Sharma ..... E21B 49/10
2016/0053612 A1 * 2/2016 Proett ..... E21B 17/1021 166/264

FOREIGN PATENT DOCUMENTS

NO 340765 B1 * 6/2017 ..... E21B 23/01

OTHER PUBLICATIONS

English translation of NO-340765-B1 from worldwide.espacenet.com.*

* cited by examiner

*Primary Examiner* — Kristina M Deherrera
*Assistant Examiner* — Jean F Morello

(57) ABSTRACT

An annular detachable rubber probe sidewall contact device includes: a body which is columnar, wherein a high-pressure output oil path and a high-pressure retracting oil path are arranged in the body; a sidewall contact arm comprising multiple polar plates which are symmetrically distributed on an external circumference of the body, wherein each of the polar plates is movably installed on the body through a piston rod, and the piston rod is perpendicular to the body; the body has a piston cavity for accommodating the piston rod, and the piston cavity communicates with both the high-pressure output oil path and the high-pressure retracting oil path; and a sampling pipe, wherein one end of the sampling pipe is connected to the polar plates, and the other end of the sampling pipe communicates with a sampling channel in the body through a sampling cavity in the body.

7 Claims, 8 Drawing Sheets

ANNULAR DETACHABLE RUBBER PROBE SIDEWALL CONTACT DEVICE

CROSS REFERENCE OF RELATED APPLICATION

The present invention claims priority under 35 U.S.C. 119(a-d) to CN 202011429456.1, filed Dec. 9, 2020.

BACKGROUND OF THE PRESENT INVENTION

Field of Invention

The present invention relates to a technical field of underground petroleum measurement, and more particularly to an annular detachable rubber probe sidewall contact device which vertically drives sidewall contact arms to contact with a well wall, so as to improve a supporting force.

Description of Related Arts

With the development of the petroleum industry, the oil exploitation and exploration technology is also more and more updated. Stratum sampling instrument is an important equipment component in oil exploration field and is used for measuring various data, such as inclination, of a current well. The stratum sampling instrument is usually mounted on a sidewall contact device that can be supported at a desired downhole location at any time.

The sidewall contact arm of the conventional sidewall contact device, no matter the quantity of the sidewall contact arm, mostly adopts a connecting rod structure consisting of a main arm, a polar plate and an auxiliary arm. The main arm, the polar plate and the auxiliary arm are unfolded from a main body after being pushed to form a parallelogram together with the main body. However, the opening angle of the main arm is limited by the supporting mechanism and is generally less than 90 degrees to adapt to oil wells with different well diameters. The unfolded sidewall contact arm presses the polar plate against the well wall for supporting, and then corresponding measurement or sampling work is carried out.

However, since the parallel structure formed by the main arm, the polar plate and the auxiliary arm is unfolded along the gravity direction, the friction force between the parallel structure and the well wall is insufficient. As a result, the support foundation is unstable, and the polar plate is easy to slide under the friction force of downhole liquid, which will influence the measurement effect.

In addition, because the angles of the unfolded main arm, the polar plate and the auxiliary arm form an inclined parallelogram, the thrust applied to the main arm by the main body is not completely transmitted to the polar plate, but is divided into a horizontal component force. The thrust applied is also limited by the volume of the main body, which means the thrust finally applied on the polar plate is reduced, and the support stability of the whole sidewall contact device is lowered.

SUMMARY OF THE PRESENT INVENTION

An object of the present invention is to provide an annular detachable rubber probe sidewall contact device which vertically drives sidewall contact arms to contact with a well wall, so as to improve a supporting force.

Accordingly, the present invention provides an annular detachable rubber probe sidewall contact device, comprising:

a body which is columnar, wherein a high-pressure output oil path and a high-pressure retracting oil path are arranged in the body;

a sidewall contact arm comprising multiple polar plates which are symmetrically distributed on an external circumference of the body, wherein each of the polar plates is movably installed on the body through a piston rod, and the piston rod is perpendicular to the body; the body has a piston cavity for accommodating the piston rod, and the piston cavity communicates with both the high-pressure output oil path and the high-pressure retracting oil path; and a sampling pipe, wherein one end of the sampling pipe is connected to the polar plates, and the other end of the sampling pipe communicates with a sampling channel in the body through a sampling cavity in the body.

According to the present invention, the piston rod is directly pushed by high-pressure hydraulic oil, and perpendicularly contacts with the well wall. As a result, the pressure of the high-pressure hydraulic oil in the high-pressure output oil path is directly and uniformly shared by all the polar plates and then applied on the well wall with no interference force. The supporting thrust can be greatly improved, the sidewall contact device can be stably maintained at a supporting position, and a better sampling effect is realized. A contact pressure between the polar plate and the well wall can be controlled by adjusting the pressure of the high-pressure hydraulic oil.

The whole sidewall contact scheme adopts a piston rod structure, and telescopic actions can be realized only by corresponding high-pressure hydraulic oil, which reduces the connecting structure and makes maintenance and control easier. Meanwhile, no dispersing forces is by applying a perpendicular acting force, so that the pressure applied to the well wall is larger and more stable. The high-pressure output oil path and the high-pressure retracting oil path are used for respectively and simultaneously controlling all the piston rods to act synchronously, so that each of the polar plates can uniformly bear the pressure of high-pressure hydraulic oil. As a result, the control process is simplified, the failure rate is correspondingly reduced, and the manufacturing cost is also lowered.

DETAILED DESCRIPTION OF THE PREFERRED EMBODIMENT

With accompanying embodiments and drawings, detailed structures and implementation of the present solution will be further described below.

Figure 1:
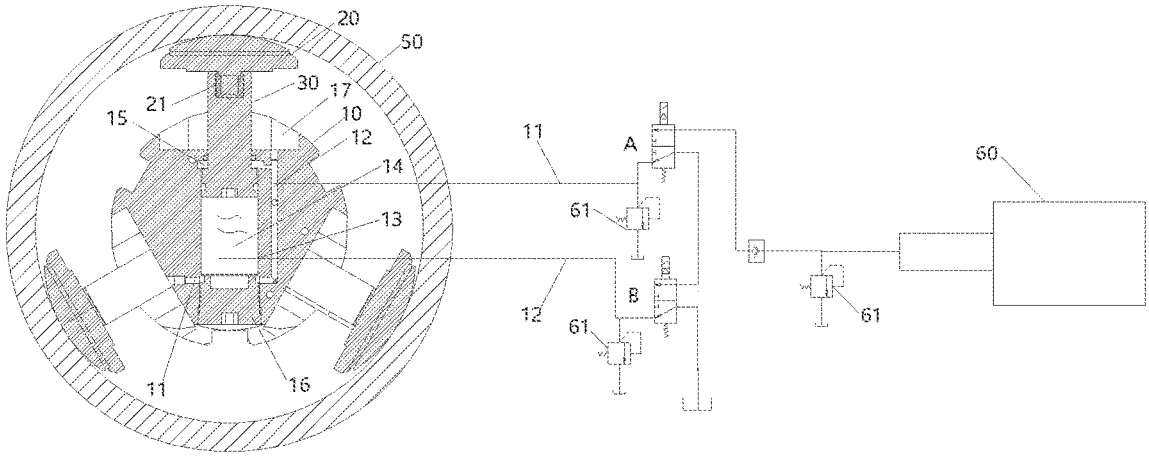
FIG. 1 illustrates a supporting state of a sidewall contact device according to an embodiment of the present invention.

Referring to FIG. 1, according to an embodiment of the present invention, an annular detachable rubber probe sidewall contact device is provided, which can be connected to a primary structure, in such a manner that the sidewall contact device can stay still downhole for supporting. Specifically, the sidewall contact device comprises a body 10, a sidewall contact arm and a sampling pipe 40.

Figure 2:
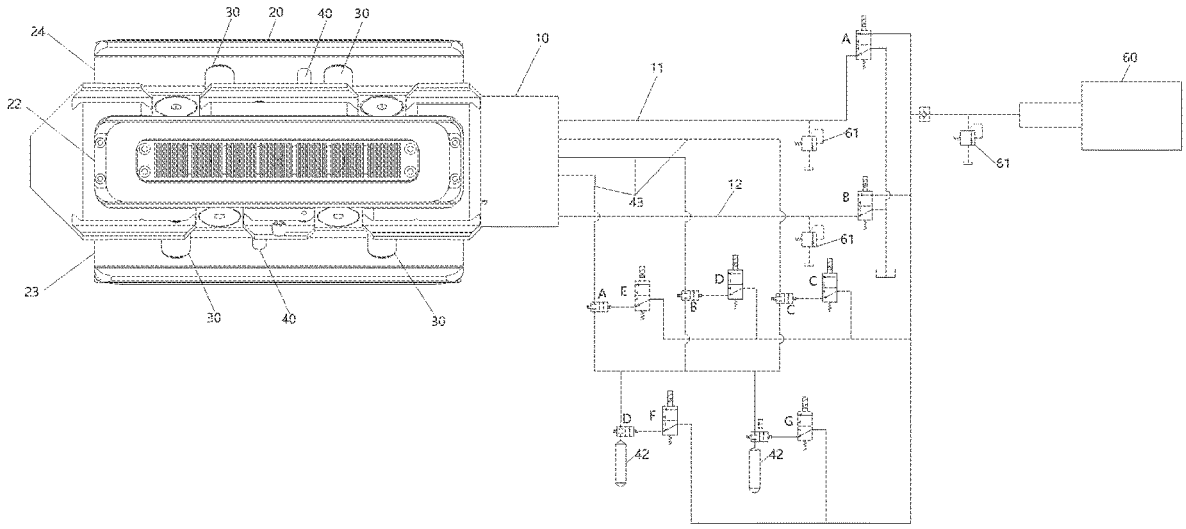
FIG. 2 is a side-deployed view of the sidewall contact device according to the embodiment of the present invention.

The body 10 is columnar, and one end thereof is connected to an advancing end of the primary structure, which acts as an independent detachable part. Referring to FIG. 2, a high-pressure output oil path 11 and a high-pressure retracting oil path 12 are arranged in the body 10, which respectively convey high-pressure hydraulic oil to drive the sidewall contact arm to stretch and retract. After the body 10 is connected with the primary structure, the high-pressure output oil path 11 and the high-pressure retracting oil path 12 respectively communicate with corresponding oil paths in the primary structure, which are controlled by a control system on the primary structure for working.

The sidewall contact arm comprises multiple polar plates 20 which are symmetrically distributed on an external circumference of the body 10, wherein each of the polar plates 20 is movably installed on the body 10 through a piston rod 30, and the piston rod 30 is perpendicular to the body 10; the body 10 has a piston cavity 13 for accommodating the piston rod 30, and the piston cavity 13 communicates with both the high-pressure output oil path 11 and the high-pressure retracting oil path 12. The high-pressure output oil path 11 can push the piston rod 30 through the high-pressure hydraulic oil, so as to achieve a stretching effect on the body 10. When the piston rod 30 stretches out, the polar plate 20 can be pushed to be in contact with the well wall 50 for supporting. After supporting, the high-pressure retracting oil path 12 can draw back the piston rod 30 to the body 10 through the high-pressure hydraulic oil, thereby driving the piston rod 30 to retract the polar plate 20 to the body 10.

Figure 3:
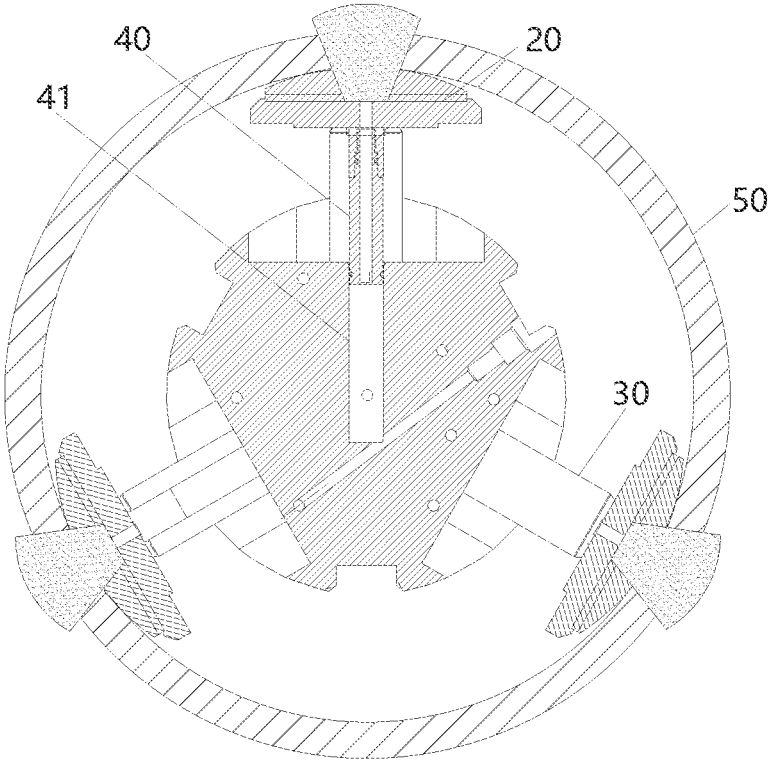
FIG. 3 illustrates a sampling state of a sampling pipe according to the embodiment of the present invention.

Referring to FIG. 3, the sampling pipe 40 is used to collect downhole samples, wherein one end of the sampling pipe 40 is connected to the polar plates 20, and the other end of the sampling pipe 40 communicates with a sampling channel in the body 10 through a sampling cavity 41 in the body 10. When the machine body 10 is connected to the primary structure, the sampling channel communicates with a sampling pump connected to the primary structure, so that the sampling pipe 40 has a corresponding extraction pressure. After the polar plate 20 contacts with the well wall 50, the sampling pipe 40 can collect and store mud samples of a current position through the extraction pressure or downhole pressure. Then the mud samples will be analyzed after the sidewall contact device is taken out of the well. Specifically, the sampling pipe 40 may adopt any known structure.

During working, the sidewall contact device of the embodiment is arranged at a lowest end of the primary structure, namely a tip part of drilling. As a result, the sidewall contact device can directly provide a support at the lowest end of the primary structure, so as to correspondingly form a support at a bottom of the well, which is conducive to measurement of each measuring instrument at an upper part.

After the body 10 is connected to the primary structure, the high-pressure output oil path 11 and the high-pressure retracting oil path 12 inside communicate with corresponding control oil paths in the primary structure, and the sampling channel connected to the sampling pipe 40 communicates with a sampling channel 43 in the primary structure.

When the sidewall contact device is lowered to a preset downhole position, a motor opens an electromagnetic valve A of a high-pressure oil cavity 60, so that the high-pressure hydraulic oil is supplied into the piston cavity 13 through the high-pressure output oil path 11, thereby stretching the piston rods 30 from body 10. Meanwhile, the piston rods 30 drive the polar plates 20 to synchronously move, while the polar plates 20 drive the sampling pipes 40 to synchronously move. Finally, the polar plates 20 are in contact with the well wall 50 and support the whole sidewall contact device at the current position. At this time, the sampling pipes 40 collect samples, and the motor controls each sampling pipe 40 through the sampling channel 43, so that the mud samples at positions where the polar plates 20 contact can enter the sampling pipes 40. Mechanical valves A, B and C are opened by electromagnetic valves C, D and E, respectively, so as to control the three sampling pipes 40 to inject sampling liquid into two sampling cylinders 42. Under the control of the electromagnetic valves C, D and E, each sampling pipe 40 can inject liquid into one of the sampling cylinders 42, or one sampling pipe 40 can inject liquid into both sampling cylinders 42, namely each sampling pipe 40 can sample and store separately.

After sampling, the electromagnetic valve A is turned off to stop the high-pressure hydraulic oil supply to the high-pressure output oil path 11. Meanwhile, the high-pressure output oil path 11 communicates with a pressure relief channel, and then the motor outputs the high-pressure hydraulic oil to the high-pressure retracting oil path 12 through the high-pressure oil cavity 60. At this time, the electromagnetic valve B is opened, and each piston rod 30 retracts to the body 10 under the action of the high-pressure hydraulic oil. The electromagnetic valves C, D and E close the mechanical valves A, B and C, while retraction of the piston rods 30 simultaneously drives the polar plates 20 and the sampling pipes 40 to retract. Finally, the polar plates 20 return to installation grooves 17 on an external surface of the body 10, and the supporting process is completed. Then the sidewall contact device is moved up or down in the wellbore, so as to continue sampling or lift away from the wellbore.

Electromagnetic valves F and G are used to open and close mechanical valves D and E, so as to remove the samples from the sampling cylinders 42. A high-pressure protective overflow valve 61 is also arranged on the whole oil path.

In the supporting process, when the high-pressure output oil path 11 outputs the high-pressure hydraulic oil to push the piston rod 30 towards the well wall 50, the high-pressure retracting oil path 12 communicates with the pressure relief channel to relieve the pressure of the high-pressure hydraulic oil and feed the relieved hydraulic oil back to the high-pressure oil cavity 60 of the primary structure through the pressure relief channel, thereby reducing a pushing resistance of the piston rod 30. The pressure relief path may be an independent pipe, and the high-pressure output oil path 11 and the high-pressure retracting oil path 12 share one pipe, which are switched and controlled by an electromagnetic valve. In addition, the high-pressure output oil path 11 and the high-pressure retracting oil path 12 may be used as the pressure relief path, which means when the high-pressure output oil path 1 or the high-pressure oil retracting path 12 is working, the other one is in a backflow state.

A corresponding sealing ring is arranged on each piston rod 30 to prevent hydraulic oil leakage when the piston rod 30 moves in the piston cavity 13. A dynamic and static sealing structure is also formed between the sampling pipe 40 and the sampling cavity 41 by a sealing ring, preventing sample leakage when the sampling pipe 40 moves in the sampling cavity 41.

According to the embodiment, the piston rod is directly pushed by high-pressure hydraulic oil, and perpendicularly contacts with the well wall. As a result, the pressure of the high-pressure hydraulic oil in the high-pressure output oil path is directly and uniformly shared by all the polar plates and then applied on the well wall with no interference force. The supporting thrust can be greatly improved, the sidewall contact device can be stably maintained at a supporting position, and a better sampling effect is realized. A contact pressure between the polar plate and the well wall can be controlled by adjusting the pressure of the high-pressure hydraulic oil.

The whole sidewall contact scheme adopts a piston rod structure, and telescopic actions can be realized only by corresponding high-pressure hydraulic oil, which reduces the connecting structure and makes maintenance and control easier. Meanwhile, no dispersing forces is by applying a perpendicular acting force, so that the pressure applied to the well wall is larger and more stable. The high-pressure output oil path and the high-pressure retracting oil path are used for respectively and simultaneously controlling all the piston rods to act synchronously, so that each of the polar plates can uniformly bear the pressure of high-pressure hydraulic oil. As a result, the control process is simplified, the failure rate is correspondingly reduced, and the manufacturing cost is also lowered.

Referring to FIGS. 1 and 2, according to the embodiment of the present invention, the sidewall contact device comprises three the polar plates 20 which are distributed on the external circumference of the body 10 with spacing of 120 degrees. After stretching, the three polar plates 20 are supported on the well wall 50 at 120 degrees in a circumference. The installation grooves 17 are provided on the body 10, whose shape is corresponding to that of the polar plate 20, so that the polar plate 20 can be embedded on the body 10 if not stretched. As a result, the outer circumference of the whole body 10 can be kept in a cylindrical shape, thereby facilitating advancing in the well.

Figure 4:
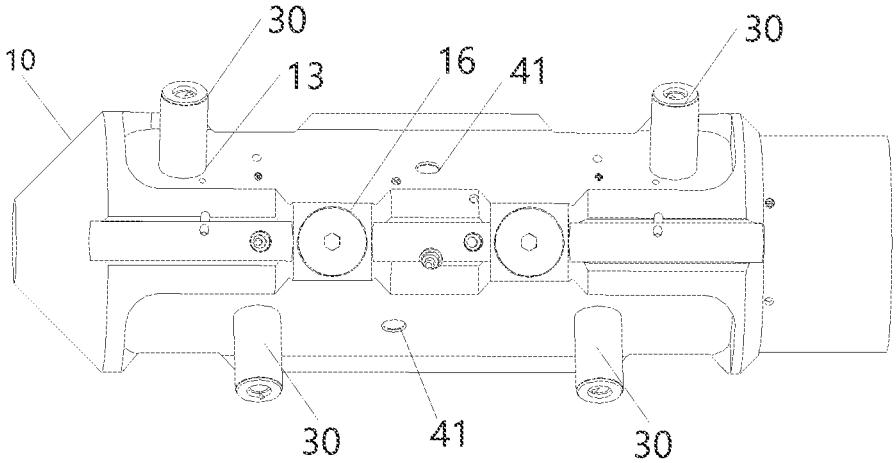
FIG. 4 is a sketch view of staggered piston rods of the sidewall contact device according to the embodiment of the present invention.

Referring to FIG. 4, two the piston rods 30 are symmetrically arranged on each of the polar plates 20, and positions of the piston cavities on the body 10, which are used to install the two piston rods 30 on each of the polar plates 20, are staggered with each other. That is to say, the positions of the piston cavities 13 of the piston rods 30 are staggered to prevent interference. At the same time, internal structure production of the body 10 can be simplified as long as the piston rods 30 are able to move synchronously.

The three polar plates 20 are defined as a polar plate A22, a polar plate B23 and a polar plate C24. A gap between two piston rods 30 connected to the polar plate A22 is the largest, followed by that of the polar plate B23, and that of the polar plate C24 is the smallest. The gap between the two piston rods 30 of each polar plate 20 is synchronously reduced, which means the two piston rods 30 of the polar plate B23 can be placed between the two piston rods 30 of the polar plate A22, and the two piston rods 30 of the polar plate C24 can be placed between the two piston rods 30 of the polar plate B23. In practice, the two piston rods 30 of each polar plate 20 on the body 10 are staggered in space. Centrosymmetric arrangement can provide a stable pressure output for each of the polar plates 20 as well as simplify a structural design, which lowers control difficulty and cost.

Preferably, output cavities 14 are arranged at one ends, which are in the body 10, of the piston cavities 13 where the piston rods 30 are installed, and the output cavities 14 communicate with the high-pressure output oil path 11; retracting cavities 15 are arranged at positions, which are close to the external circumference of the body 10, of the piston cavities 13, and the retracting cavities 15 communicate with the high-pressure retracting oil path 12. From the aspect of simplifying the manufacturing, each piston cavity 13 is a through passage provided on the body 10, and an overall length of the piston rod 30 is shorter than a length of the piston cavity 13, so that the output cavity 14 can be a part of the piston cavity 13. An opening at an end far away from a stretching end of the piston rod 30 is sealed by a sealing plug 16, and the output cavity 14 is formed by a cavity between the sealing plug 16 and a bottom of the piston rod 30. The retracting cavity 15 is formed by arranging corresponding concave grooves on the piston rod 30, and corresponding sealing rings are arranged at two ends of the concave groove to prevent high-pressure hydraulic oil from leaking. In addition, the concave groove is arranged at a position which is positioned in the piston cavity 13 after the piston rod 30 is stretched to a maximum distance, which will not affect normal stretching and retracting of the piston rod 30.

More hydraulic oil can be accommodated with the outlet cavity 14 and the retracting cavity 15, so that the piston rod 30 can be stretched and retracted more quickly. Driving principle and the sampling principle of each piston rod can be seen from the description of FIG. 3, and will not be repeated here.

Figure 5:
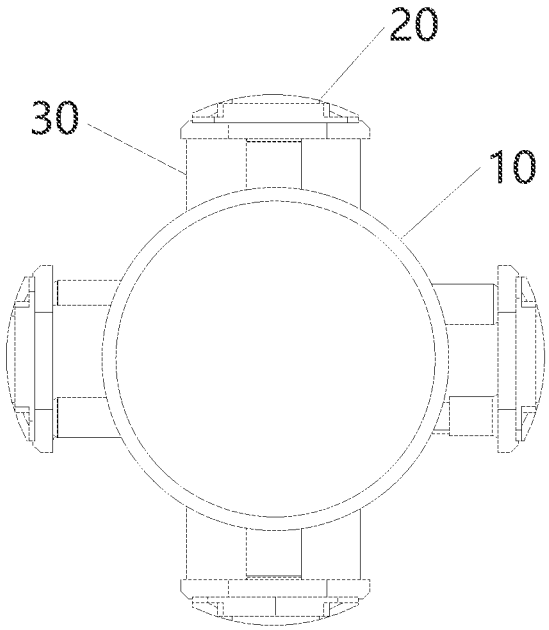
FIG. 5 is a sketch view of the sidewall contact device with four polar plates according to the embodiment of the present invention

Referring FIG. 5, according to another embodiment of the present invention, the sidewall contact device comprises four the polar plates 20 which are distributed on the external circumference of the body 10 with spacing of 90 degrees. After being unfolded, the four polar plates 20 support the whole sidewall contact device in a perpendicular manner. The four polar plates 20 are also driven by the piston rods 30 to stretch and retract.

Figure 6:
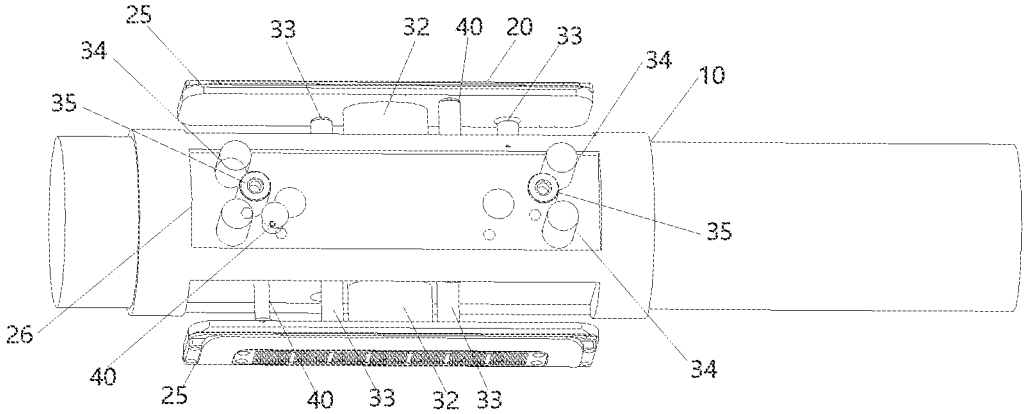
FIG. 6 is a side view of the four polar plates of the sidewall contact device under an unfolded state according to the embodiment of the present invention.
Figure 8:
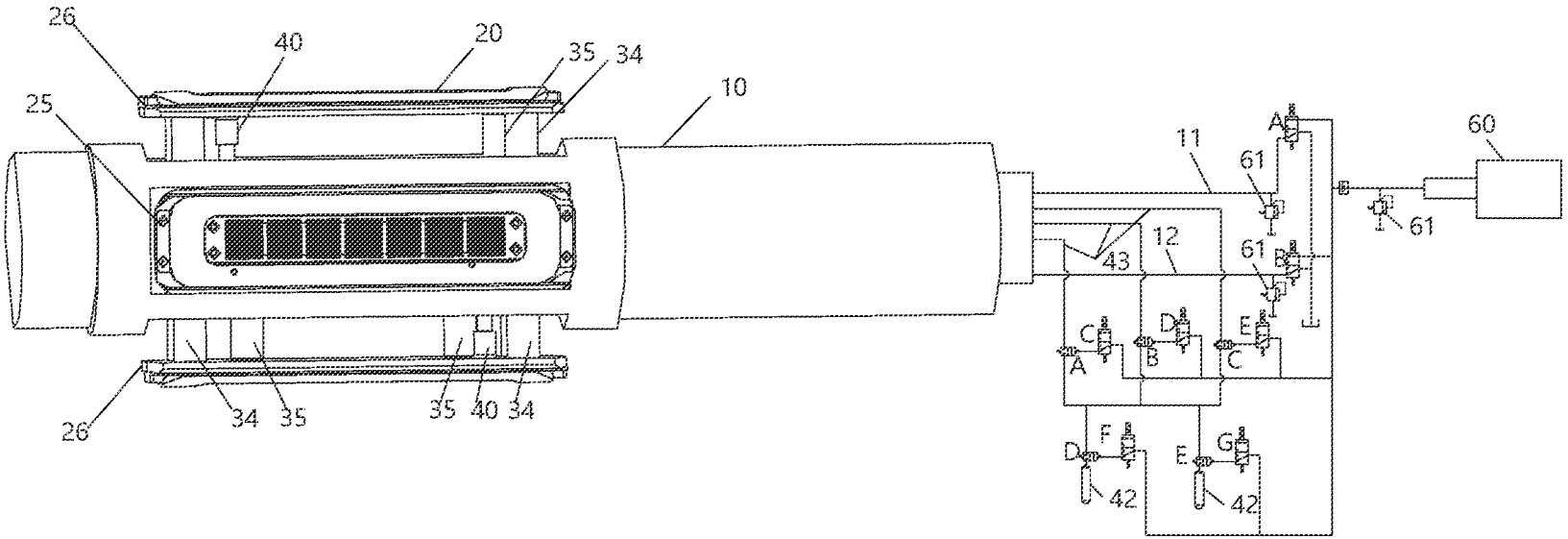
FIG. 8 is a sketch view of the polar plates in a group B under the unfolded state according to the embodiment of the present invention.

Referring to FIGS. 6 and 8, in the four polar plates 20, two pairs of opposite polar plates 20 are respectively defined as a group A 25 and a group B 26. Piston rod structures of the two polar plates 20 in the same group are identical and are symmetrically arranged, while the piston rod driving structures and arrangements of the group A and the group B are different. That is to say, in the embodiment, the arrangements and driving modes of the piston rods 30 of the polar plates 20 in the same group are identical, while the piston rod structures and driving structures in different groups may be different.

For example, with different driving modes and different arrangements for different groups, two pairs of opposite polar plates 20 are respectively defined as a group A 25 and a group B 26. Referring to FIG. 6, the piston rods 30 in the group A 25 comprise a pushing piston rod 32 respectively connected to middle parts of the two polar plates 20 in the group A, and two retracting piston rods 33 arranged at two sides of each of the pushing piston rods 32 to be connected to the polar plates 20. On the body 10, the piston cavity 13 for installing the two pushing piston rods 32 which are connected to the two opposite polar plates 20 is a through channel, and the two pushing piston rods 32 are arranged at two ends of the same piston cavity 13 respectively.

Figure 7:
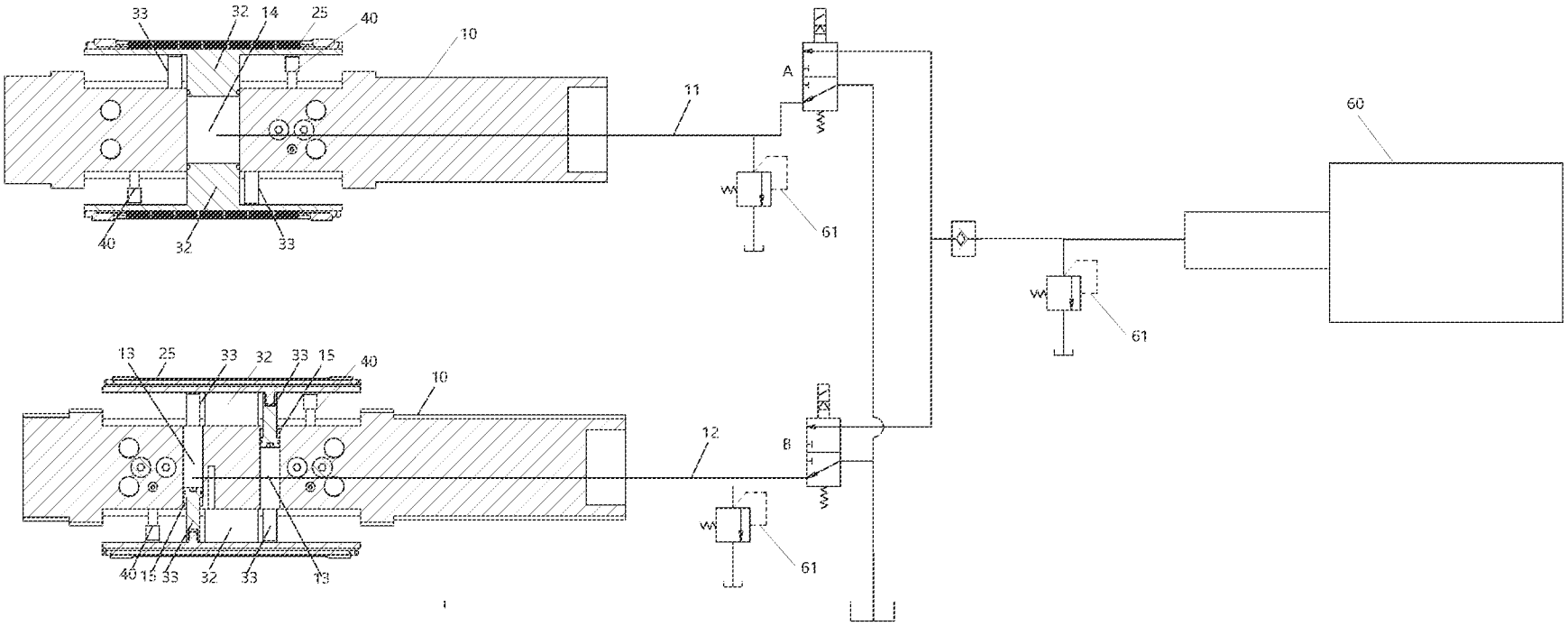
FIG. 7 is a cross-sectional view of pushing piston rods and retracting piston rods in FIG. 6 while illustrates oil path and sampling control principles.

FIG. 7 is a cross-sectional view of the pushing piston rods 32 and the retracting piston rods 33 in FIG. 6 while illustrates high-pressure hydraulic oil connection therebetween, wherein an output cavity 14 is provided at the piston cavity 13 between the two pushing piston rods 32, which communicates with the high-pressure output oil path 11.

The two retracting piston rods 33 connected to the same polar plate 20 are staggered, and the two retracting piston rods 33 connected to the opposite polar plates 20 are also staggered, which means the piston cavities 13 for installing the four retracting piston rods 33 connected to the four polar plates 20 are independent and staggered on the body 10. Retracting cavities 15 communicating with the high-pressure retracting oil path 12 are arranged at positions, which are close to the external circumference of the body 10, of the piston cavities 13 for mounting the retracting piston rods 33. The other end of the piston cavity 13 for mounting the retracting piston rod 33 are sealed by a sealing plug 16.

During working, the high-pressure output oil path 11 injects the high-pressure hydraulic oil from the high-pressure oil cavity 60 into the output cavity 14 through the motor, so as to simultaneously stretch the two pushing piston rods 32 at two ends of the piston cavity 13, thereby pushing the two polar plates 20 to contact with the well wall 50 and driving the sampling pipes 40 to sample. During retracting after sampling, the high-pressure output oil path 11 is relieved, and the high-pressure hydraulic oil in the high-pressure oil cavity 60 is injected into the retracting cavities 15 of the retracting piston rods 33 through the high-pressure retracting oil path 12 through the motor, so as to simultaneously retract the four retracting piston rods 33 connected to the two opposite polar plates 20, thereby simultaneously retracting the two pushing piston rods 32 to the body 10. Finally, the two polar plates 20 and the sampling pipes 40 are retracted to the body 10 to complete the supporting process. During stretching and retracting of the group A 25, input and output of the high-pressure hydraulic oil are switched by the electromagnetic valves A and B. Meanwhile, the overflow valve 61 arranged on the oil path is used for high-pressure protection.

With the foregoing structure, although the piston rods 30 for stretching and retracting the polar plates 20 are divided into the pushing piston rod 32 and the retracting piston rods 33 which are independently of each other, the specific oil supplying and pressure relieving processes are the same as those described above, and will not be described in detail here. In addition, for convenience of description, it is mentioned that the piston rods 30 in the same group are synchronously operated, while operating state of the other group is not mentioned. However, in practice, the piston rods 30 in the group A 25 as well as those in the group B 26 are synchronously operated.

Preferably, referring to FIG. 7, the piston rods 30 in the group B 26 comprise four pushing piston rods 34 respectively connected to two ends of each bottom surface of the two polar plates 20 in the group B 26, which means each end is connected to two pushing piston rods 34, and two retracting piston rods 35 arranged between the four pushing piston rods 34; the four pushing piston rods 34 of the two opposite polar plates 20 are symmetrically arranged at two ends of the same piston cavity 13.

Figure 9:
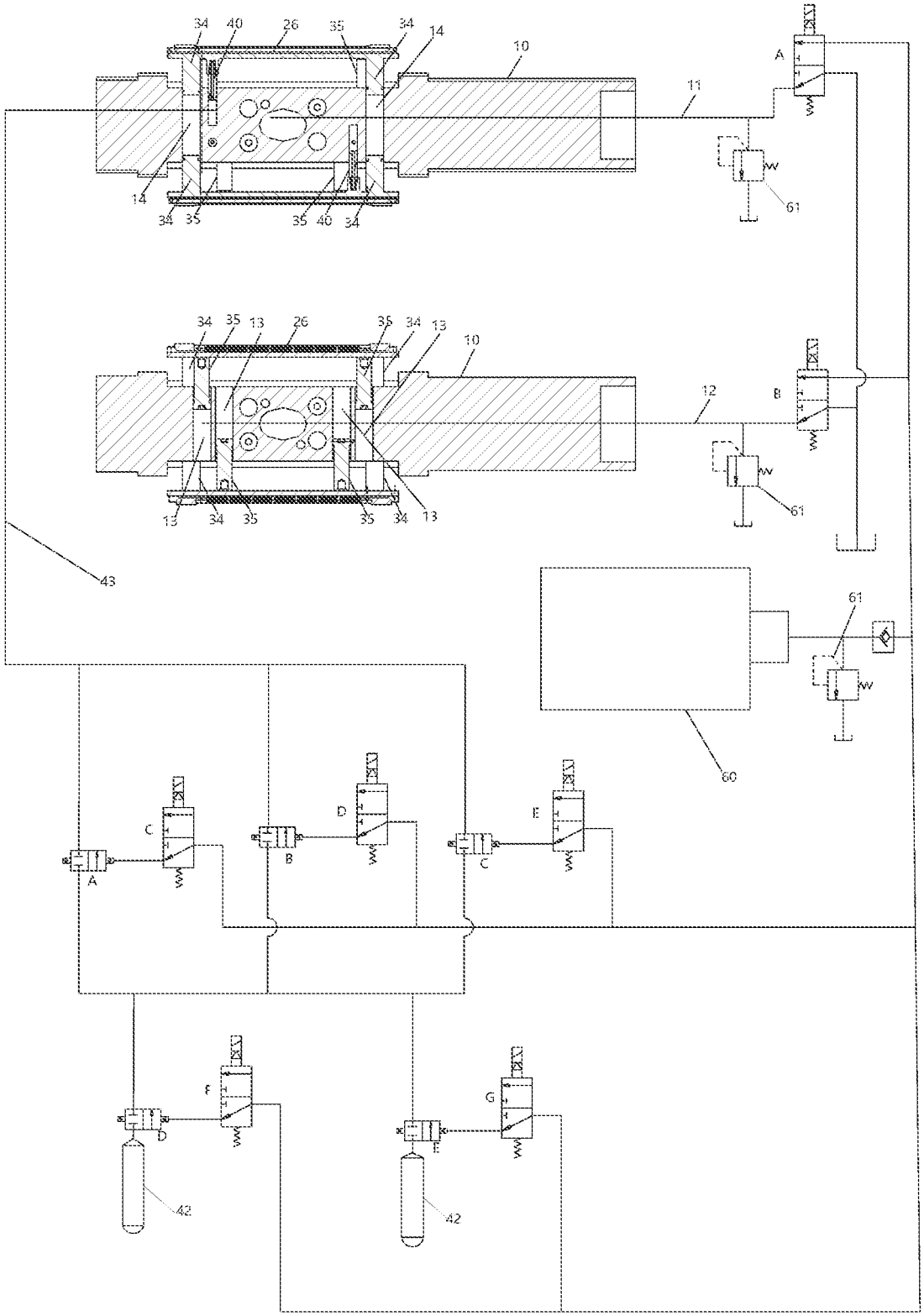
FIG. 9 is a cross-sectional view of the pushing piston rods and the retracting piston rods in FIG. 8 while illustrates the oil path and sampling control principles.

FIG. 9 is a cross-sectional view of the pushing piston rods 34 and the retracting piston rods 35 in FIG. 8 while illustrates the oil paths thereof. Output cavities 14 are provided at middle parts of the four piston cavities 13, which communicates with the high-pressure output oil path 11; the two retracting piston rods 35 connected to the same polar plate 20 are staggered, and the two retracting piston rods 35 connected to the opposite polar plates 20 are also staggered, wherein means the four piston cavities 13 are used for installing the retracting piston rods 35, and the piston cavities 13 are staggered. Retracting cavities 15 communicating with the high-pressure retracting oil path 12 are arranged at positions, which are close to the external circumference of the body 10, of the piston cavities 13 for mounting the retracting piston rods 35.

Different from those in the group A 25, the pushing piston rods 34 in the group B 26 are arranged at two ends of the polar plates 20, and multiple pushing piston rods 34 are adopted. The high-pressure oil is also injected into the output cavity 14 in the piston cavity 13 through the high-pressure output oil path 11 on the primary structure, so as to synchronously stretching the pushing piston rods 34 at two ends. Finally, the polar plates 20 contact with the well wall 50 and the sampling pipe 40 is used for sampling. After sampling, the output cavity 14 is relieved, and the high-pressure oil is injected into the retracting cavity 15 through the high-pressure retracting oil path 12. As a result, the retracting piston rod 35 of each polar plate 20 simultaneously retracts the pushing piston rods 34 into the body 10, and simultaneously retracts the polar plate 20 and the sampling pipe 40 to body 10. Control and sampling processes of the electromagnetic valves A, B, C, D, E, F and G as well as the mechanical valves A, B, C, D and E are the same as those illustrated in the FIG. 3, and will not be repeated here. It should be noted that although the group A 25 and the group B 26 are described separately, the two groups are operated synchronously in practice.

According to the embodiment, although the arrangement of the group A 25 and the group B 26 are different, the operation modes are the same, which adopt two independent sets of piston rods 30 to stretching and retracting the polar plates 20 respectively. The polar plate 20 bears a perpendicular pressure and applies a perpendicular pressure to the well wall 50. Therefore, the pressure is completely applied to the well wall 50 without component force, in such a manner that the support strength of the sidewall contact device is greatly improved, and the sampling process is facilitated.

According to the embodiment, in the group A 25 and the group B 26, all the sampling pipes 40 are staggered from each other, and each sampling pipe 40 is connected to the sampling channel through the sampling cavity 41.

Figure 10:
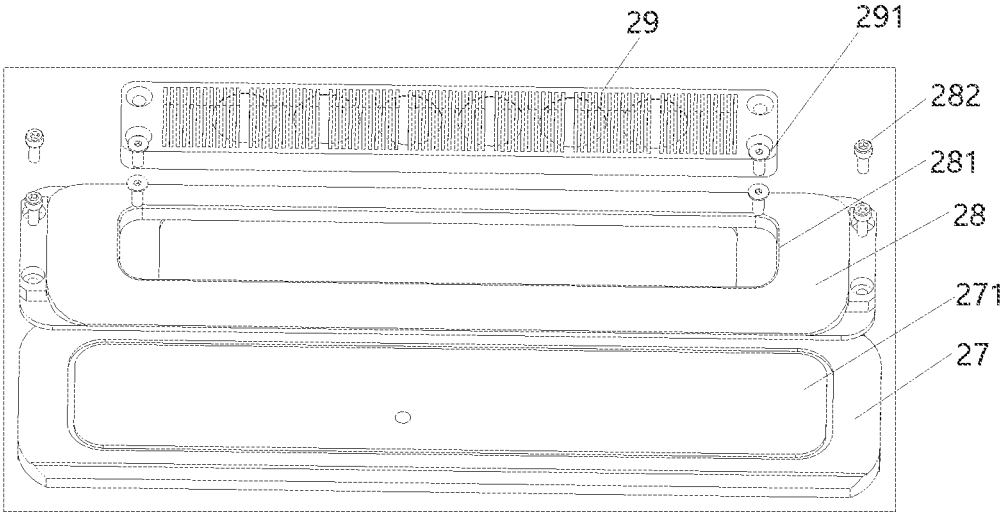
FIG. 10 is a structural view of the polar plate according to the embodiment of the present invention.

Referring to FIG. 10, according to the embodiment of the present invention, surfaces of the polar plates 20, which are away from the body 10, are convex arc surfaces, so as to fit the arc well wall 50. Specifically, each of the polar plates 20 comprises a base 27 having a concave cavity 271; a rubber layer 28 is installed on a surface of the base 27, and a strip groove 281 corresponding to an opening shape of the concave cavity 271 is provided on the rubber layer 28. The rubber layer 28 is fixed on the base 27 by a bolt 282. A screen 29 for filtering impurity is installed in the concave cavity 271, and the screen 29 is fixed on the strip groove 281 of the rubber layer 28 by a bolt 291.

A threaded rod 21 is arranged at an end, which faces the body 10, of the base 27, and the threaded rod 21 is fixed with the piston rod 30 through threads. The sampling pipe 40 passes through the base 27 to communicate with the concave cavity 271, thereby sampling liquid in the concave cavity 271 after the liquid is filtered by the screen 29.

The base 27 is generally made of metal and needs to satisfy a certain supporting strength. The rubber layer 28 can increase a friction force when contacting with the well wall 50, as well as provide a certain buffer capacity to relieve an impact force when the polar plate 20 contacts with the well wall 50. The screen 29 prevents large particles from entering the concave cavity 271 and blocking the sampling pipe 40. One end of each piston rod 30 is screwed with the threaded rod 21 through internal threads and then is installed in the corresponding piston cavity 13, wherein with threaded connection, pressure loss can be reduced by adopting, stability of the polar plate 20 is improved, and thrust is better transmitted. The rubber layer 28 and the screen 29 mounted by the bolts 282 and 291 can be easily detached for maintenance.

Preferably, the sampling pipes 40 connected to the polar plates 20 can be connected to different sampling channels 43, so that different sampling pipes 40 can be controlled by the primary structure to sample separately. As a result, the sidewall contact device can sample at multiple positions at a time, which improves sampling efficiency. Multiple sampling channels 43 can be adopted for independent control, or one sampling channel 43 is controlled by the electromagnetic valves to communicate with the corresponding sampling pipe 40.

Figure 11:
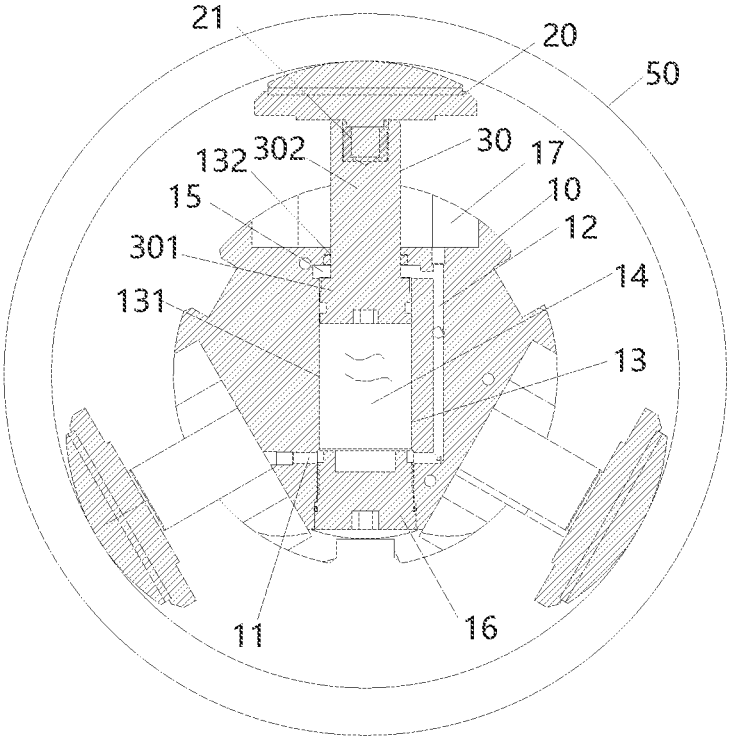
FIG. 11 is a sketch view of a working state of the piston rods according to the embodiment of the present invention.
Figure 12:
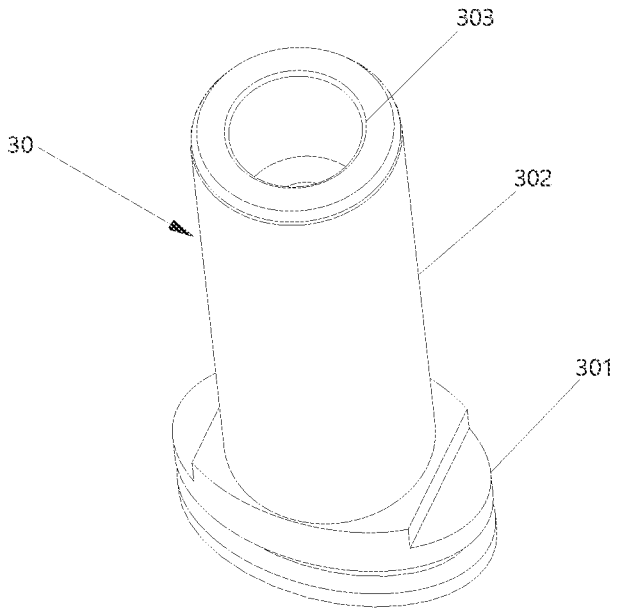
FIG. 12 is a perspective view of a piston cylinder according to the embodiment of the present invention.

Referring to FIGS. 11 and 12, according to the embodiment of the present invention, the piston rod 30 comprises a cylindrical shaft 302 and an elliptical base 301; a surface area of the elliptical base 301 is larger than a cross-sectional area of the cylindrical shaft 302; a cross section of the piston cavity 13 of the piston rod 30 is an elliptical cavity corresponding to a bottom of the elliptical base 301; a circular hole, whose diameter is larger than a long axis of the elliptical cavity, is opened at a position of the piston cavity 13 which is corresponding to the cylindrical shaft 302; a sealing ring 36 is installed in the circular hole, and a cylindrical section 132 for containing the cylindrical shaft 302 is arranged at a center of the sealing ring 36, which means the elliptical piston cavity 13 is divided by the sealing ring 36 into an elliptical section 131 where the elliptical base 301 moves and the cylindrical section 132 where the cylindrical shaft 302 moves.

The elliptical base 301 is located at an end which is in contact with the hydraulic oil. The elliptical base 301 can increase a contact area with the hydraulic oil to increase the thrust of the piston rod 30, so that the sidewall contact device can provide more stable support downhole. The elliptical piston cavity 13 can provide larger bearing area while occupies less space, which facilitates installation of other pipes and the piston rods 30 on the body 10. In addition, the elliptical base 301 cooperates with the elliptical section 131 to prevent the piston rod 30 from rotating.

During working, the elliptical base 301 is pushed by the hydraulic oil to drive the cylindrical shaft 302 in the piston cavity 13 to extend from the body 10, thereby pushing the polar plate 20 to contact with the well wall. When the elliptical base 301 in the piston cavity 13 moves from the elliptical section 131 to the cylindrical section 132, it is blocked by the sealing ring 36 at the cylindrical section 132 to prevent the piston rod 30 from coming out. Under normal settings, a length of the elliptical section 131 is larger than a distance between the polar plate 20 and the well wall. That is to say, before the elliptical base 301 touches the cylindrical section 132, the polar plate 20 has abutted against the well wall, wherein the length of the elliptical section 131 is a maximum stroke of the piston rod 30.

According to the embodiment, the piston cavity 13 may adopt two structures. According to the first structure, an elliptical through hole is directly drilled on the body 10. After the piston rod 30 is installed in the piston cavity 13, one end is equipped with the sealing ring 36 in the aforementioned manner, while the other end is sealed by screwing a solid sealing plug 16 into the opening. Such structure is simple to process and can reduce costs.

Figure 13:
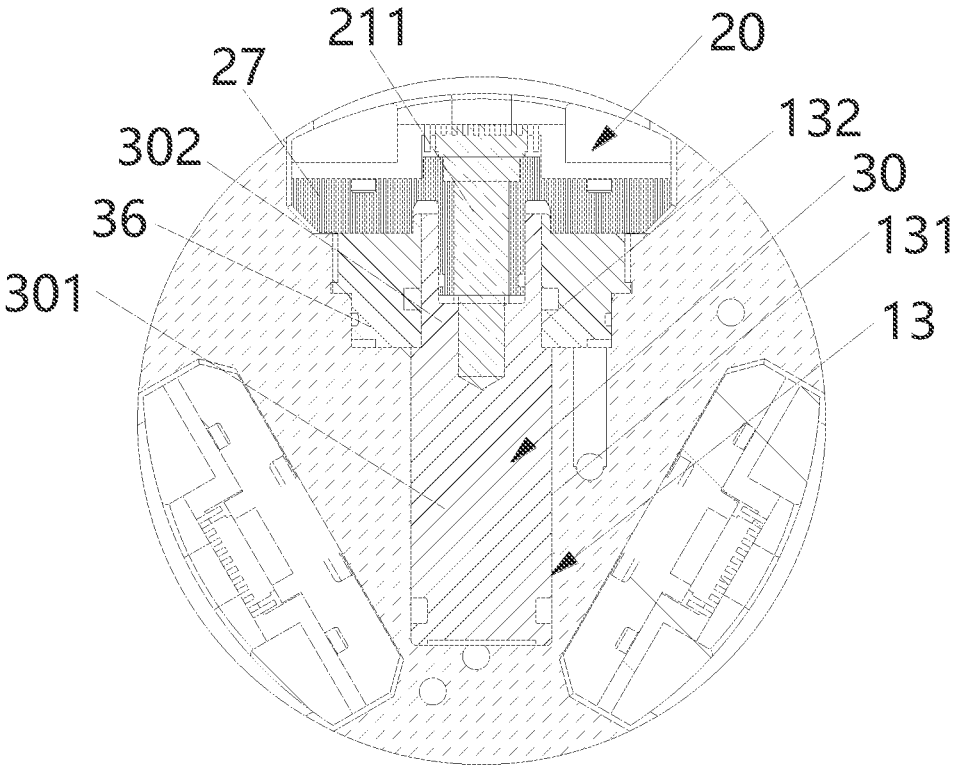
FIG. 13 illustrates connection between a piston cavity structure and the polar plate according to the embodiment of the present invention.

Referring to FIG. 13, according to the second structure, an elliptical channel which does not penetrate the body 10 is open on the body 10 as the piston cavity 13. After the piston rod 30 is installed in the piston cavity 13, the seal ring 36 is installed in the aforementioned manner. Such structure needs to measure a movement distance of the piston rod 30 in advance to determine a depth of the piston cavity 13. The manufacturing process is finer, and there is no need to seal the other end, so the overall stability is higher.

Furthermore, although the piston rod 30 is connected to the threaded rod 21 fixed on the polar plate 20 as described above, the following installation manners can also be adopted:

a recessed threaded hole 303 is provided at an end of the cylindrical shaft 302, and a through hole for a bolt 211 is opened on a base 27 of the polar plate 20; a position of the through hole is corresponding to the position of each piston rod 30; after being inserted into the through hole, the bolt 211 is screwed with the threaded hole 303 on the cylindrical shaft 302, so as to fix the polar plate 20 with the piston rod 30. With such structure, the polar plate 20 and the piston rod 30 can be connected and detached even more easily.

So far, those skilled in the art should realize that although multiple embodiments of the present invention have been illustrated and described in detail, other variations or modifications consistent with the principles of the present invention may be directly determined or derived from the disclosure above without departing from the spirit and scope of the present invention. Accordingly, the scope of the present invention should be understood and interpreted as to cover all such variations or modifications.

What is claimed is:

1. An annular detachable rubber probe sidewall contact device, comprising:

a body which is columnar, wherein a high-pressure output oil path and a high-pressure retracting oil path are arranged in the body;

multiple polar plates symmetrically distributed on an external circumference of the body, wherein each of the polar plates is movably installed on the body through a piston rod, and the piston rod is perpendicular to the body; the body has a piston cavity for accommodating the piston rod, and the piston cavity communicates with both the high-pressure output oil path and the high-pressure retracting oil path; and a sampling pipe, wherein one end of the sampling pipe is connected to the polar plates, and the other end of the sampling pipe communicates with a sampling channel in the body through a sampling cavity in the body;

wherein three the polar plates are distributed on the external circumference of the body with spacing of 120 degrees;

wherein two piston rods are symmetrically arranged on each of the polar plates, and positions of the piston cavities on the body, which correspond to the two piston rods on each of the polar plates, are staggered with each other.

2. The annular detachable rubber probe sidewall contact device, as recited in claim 1, wherein output cavities are arranged at one end, which are in the body, of the piston cavities, and the output cavities communicate with the high-pressure output oil path; retracting cavities are arranged at positions, which are close to the external circumference of the body, of the piston cavities, and the retracting cavities communicate with the high-pressure retracting oil path.

3. The annular detachable rubber probe sidewall contact device, as recited in claim 1, wherein surfaces of the polar plates, which are away from the body, are convex arc surfaces; each of the polar plates comprises a base having a concave cavity; a threaded rod is arranged at an end, which faces the body, of the base, and the threaded rod is fixed with the piston rod through threads; a screen for filtering impurity is installed in the concave cavity; the sampling pipe passes through the base to communicate with the concave cavity.

4. The annular detachable rubber probe sidewall contact device, as recited in claim 1, wherein the piston rod comprises a cylindrical shaft and an elliptical base; a surface area of the elliptical base is larger than a cross-sectional area of the cylindrical shaft; a cross section of the piston cavity is an elliptical cavity corresponding to a bottom of the elliptical base; the piston cavity is a through hole penetrating the body or a channel not penetrating the body; a circular hole, whose diameter is larger than a long axis of the elliptical cavity, is opened at a position of the piston cavity which is corresponding to the cylindrical shaft; a sealing ring is installed in the circular hole, and a cylindrical section for containing the cylindrical shaft is arranged at a center of the sealing ring; an end of the through hole, which is opposite to the cylindrical section, is closed by a sealing plug;

a recessed threaded hole is provided at an end of the cylindrical shaft, and a bolting through hole is opened on a base of the polar plate; after being inserted into the bolting through hole, a bolt is screwed with the threaded hole on the cylindrical shaft, so as to fix the polar plate with the piston rod.

5. An annular detachable rubber probe sidewall contact device, comprising:

a body which is columnar, wherein a high-pressure output oil path and a high-pressure retracting oil path are arranged in the body;

multiple polar plates symmetrically distributed on an external circumference of the body, wherein each of the polar plates is movably installed on the body through a piston rod, and the piston rod is perpendicular to the body; the body has a piston cavity for accommodating the piston rod, and the piston cavity communicates with both the high-pressure output oil path and the high-pressure retracting oil path; and a sampling pipe, wherein one end of the sampling pipe is connected to the polar plates, and the other end of the sampling pipe communicates with a sampling channel in the body through a sampling cavity in the body;

wherein four the polar plates are distributed on the external circumference of the body with spacing of 90 degrees;

wherein in the four polar plates, two pairs of opposite polar plates are respectively defined as a group A and a group B; piston rod driving structures and installation modes of the group A and the group B are different, while the piston rod driving structures in the same group are identical and are symmetrically arranged.

6. The annular detachable rubber probe sidewall contact device, as recited in claim 5, wherein the piston rods in the group A comprise two pushing piston rods respectively connected to the two polar plates in the group A, and two retracting piston rods arranged at two sides of each of the pushing piston rods; the two pushing piston rods connected to the two opposite polar plates are arranged at two ends of the same piston cavity respectively; an output cavity is provided at a middle part of the piston cavity, which communicates with the high-pressure output oil path; the two retracting piston rods connected to the same polar plate are staggered, and the two retracting piston rods connected to the opposite polar plates are also staggered; retracting cavities communicating with the high-pressure retracting oil path are arranged at positions, which are close to the external circumference of the body, of the piston cavities for mounting the retracting piston rods.

7. The annular detachable rubber probe sidewall contact device, as recited in claim 5, wherein the piston rods in the group B comprise four pushing piston rods respectively connected to bottom surfaces of the two polar plates in the group B, and two retracting piston rods arranged between the four pushing piston rods; the four pushing piston rods of the two opposite polar plates are symmetrically arranged at two ends of the same piston cavity; an output cavity is provided at a middle part of the piston cavity where the four pushing piston rods are arranged, which communicates with the high-pressure output oil path; the two retracting piston rods connected to the same polar plate are staggered, and the two retracting piston rods connected to the opposite polar plates are also staggered; retracting cavities communicating with the high-pressure retracting oil path are arranged at positions, which are close to the external circumference of the body, of the piston cavities for mounting the retracting piston rods.

* * * * *